United States Patent [19]

Manservisi et al.

[11] Patent Number: 4,612,803

[45] Date of Patent: Sep. 23, 1986

[54] CIGARETTE TESTING AND/OR LEVELING DEVICE

[75] Inventors: Renato Manservisi, Bologna; Dario Cavicchi, Ferrara, both of Italy

[73] Assignee: Sasib S.p.A., Bologna, Italy

[21] Appl. No.: 603,285

[22] Filed: Apr. 20, 1984

[30] Foreign Application Priority Data

Apr. 22, 1983 [IT] Italy ..... 12497 A/83

[51] Int. Cl.[4] ..... G01N 3/48

[52] U.S. Cl. ..... 73/81; 53/54; 131/907; 209/535

[58] Field of Search ..... 73/81, 819; 53/54, 507; 221/6; 209/535, 539; 131/907, 909

[56] References Cited

U.S. PATENT DOCUMENTS

| | | | |
|---|---|---|---|
| 3,116,478 | 12/1963 | Powell | 73/81 X |
| 3,192,389 | 6/1965 | Schmermund | 73/81 X |
| 3,207,308 | 9/1965 | Kemp . | |
| 3,468,416 | 9/1969 | Hester . | |
| 3,520,394 | 7/1970 | Seragnoli | 53/54 X |
| 3,722,172 | 3/1973 | Seragnoli | 53/54 |
| 3,874,227 | 4/1975 | Focke | 73/81 X |
| 4,142,406 | 3/1969 | Focke | 73/819 |
| 4,266,674 | 5/1981 | Bell et al. | 209/536 |
| 4,363,332 | 12/1982 | Preston et al. | 131/282 |
| 4,376,484 | 3/1983 | Seragnoli | 209/535 |
| 4,445,520 | 5/1984 | Knight et al. | 131/907 X |

*Primary Examiner*—Stewart J. Levy
*Assistant Examiner*—Joseph W. Roskos
*Attorney, Agent, or Firm*—Spencer & Frank

[57] ABSTRACT

The invention relates to a feeler pin device for the quality and/or quantity testing, and/or the levelling of cigarettes. The device comprises a plurality of feeler pins which are set in a substantially co-axial relation with the cigarettes to be tested or levelled, and which are moved from a retracted rest position axially toward the respective cigarettes, so as to contact the cigarette ends, whereby they apply thereon an elastic pressure, such as to shift the cigarette or the cigarettes against a suitable abutment for aligning same, and/or they signal the presence or absence of cigarettes, or the degree of filling of the ends thereof, and/or the presence or the absence of the filter tip, by the aid of means responsive to the stroke length of each feeler pin with respect to its support. The feeler pins are held in their retracted rest position within a fixed support against the bias of biasing springs, by control means which let the feeler pins free to move forward, with respect to their support, under the action of the associated biasing springs, toward the corresponding cigarette or cigarettes to be tested and/or levelled, and which will retract, against the action of the biasing springs, the feeler pins into their rest position.

17 Claims, 4 Drawing Figures

CIGARETTE TESTING AND/OR LEVELING DEVICE

BACKGROUND AND SUMMARY OF THE INVENTION

The invention refers to the devices for the quality and/or quantity testing, and/or the levelling of cigarettes or any other rod-like articles, particularly in the tobacco processing industry, such as cigarette filter rods, or the like.

The invention refers particularly to the quality and/or quantity testing, and/or the levelling devices of the aforementioned kind, comprising one or more feeler pins set in a substantially co-axial relation with the cigarette or cigarettes to be controlled or to be levelled, and being moved from a retracted rest position axially toward the respective cigarette or cigarettes, so as to be caused to contact the ends thereof, whereby they apply thereon an elastic pressure, such as to shift the cigarette or the cigarettes against a suitable abutment for aligning same, and/or they signal their presence or absence, and/or the degree of filing of their ends, and/or the presence or the absence of the filter tip, by the aid of means being responsive to the stroke length of each feeler pin with respect to its support.

To perform, for example, the cigarette quantity testing, use is generally made of devices of the aforementioned kind, comprising a plurality of parallel feeler pins arranged in matching relation with the cigarettes of an orderly cigarette group, which is, for example, intended for making up a pack of cigarettes.

In the heretofore known devices, the feeler pins are mounted for an axially sliding movement within a feeler pin-carrying block, so as to project therefrom in the direction of the cigarettes, and are elastically urged toward the same by counter springs. In order to effect the testing, the whole feeler pin-carrying block is moved toward the cigarette group to be controlled so as to cause the feeler pins to be slightly pressed axially against the ends of the respective cigarettes. As the feeler pin runs into the matching cigarette, this pin moves axially back relatively to the feeler pin-carrying block, against the bias of the respective counter spring. The backward movement of the feeler pin is used as an indication of the presence of a cigarette. When a feeler pin does not run into a cigarette, it will not move back relatively to the feeler pin-carrying block, and its failure to move back is an indication of the absence of a cigarette.

To perform, for example, the cigarette quality testing, that is to say, the testing of the degree of filling of the cigarette ends, and/or of the presence of the filter tip, use is made of devices of the aforementioned kind, which are, for example, situated in correspondence of the hopper for feeding the cigarette-packing machines, and which comprise either one feeler pin, or two or more succeeding superposed feeler pins in matching relation with each duct for guiding the cigarettes down in said hopper. Also the operation of these known devices is the same as aforedescribed, and they comprise at least one feeler pin-carrying block, which is moved from a retracted rest position toward the cigarette or the cigarettes to be controlled, and in which the feeler pin or pins are elastically mounted so as to be axially slidable, and as to be backward movable.

The known testing devices of the aforementioned kind have several drawbacks, arising from the fact that upon every control, the feeler pin-carrying block is moved from a retracted rest position toward the cigarettes, and backward therefrom. In fact, in the first place, the movement of the whole feeler pin-carrying involves a complicated construction and needs cumbersome control devices, such as, for example, of the cam and lever type, to be provided. Moreover, particularly when the feeler pin-carrying block has a relevant mass and inertia, and/or when the cigarettes and cigarette groups to be tested follow each other at a very fast rate, it is also difficult and costly to synchronize the reciprocating movement of the feeler pin-carrying block with the sequential transition of the cigarettes to be tested in front of the said block. These problems arise, for example, when a device with a movable feeler pin-carrying block is used for the quality testing of cigarettes running down by steps through the cigarette-guiding ducts arranged side-by-side in the hopper for feeding a cigarette-packing machine. In fact, in this instance, the individual feeler pin-carrying blocks are each associated to one cigarette-guiding duct, and are joined the one to the other, so that they compose a feeler pin-carrying bar-like member extending across the entire width of the hopper. When considering that the number of the cigarette-guiding ducts arranged side-by-side in the feeding hopper of the packing machine may be equal to the number of the cigarettes contained in one pack, then the width of the hopper, and therefore the length of said bar-like member, may reach very large dimensions. Such a long bar-like member carrying the feeler pins has a considerable mass and consequently a considerable inertia, and must reciprocate at a very high rate, such as, for example, of 400 reciprocating motions per minute, so that its operation in synchronism with the downward running of the cigarettes through the cigarette-guiding ducts is very difficult, and requires cumbersome, complicated and costly driving means.

The invention aims to eliminate the aforementioned drawbacks of the known devices, and substantially resides in the fact that instead of causing the support of the feeler pin or pins to be moved toward the cigarettes and backward therefrom, control means are provided which let the feeler pin or pins free to move forward with respect to their support, under the bias of associated biasing springs, from a retracted rest position toward the matching cigarette or cigarettes to be tested, and which will retract subsequently the feeler pin or pins into their rest position within their support, against the bias of the respective biasing springs.

Thus, according to the invention, the block supporting the feeler pin or pins is kept stationary, and the feeler pin or pins are allowed, under the bias of the associated previously loaded biasing springs, to move from a retracted rest position in which they are held by suitable control means, toward the respective cigarettes to be tested and/or to be levelled. Any time a cigarette is present or is provided with the filter tip, and/or the degree of filling of a cigarette end is a regular one, the respective feeler pin is caused to move forward under the bias of the associated biasing spring, substantially only as far as to contact the cigarette, so that it stops after a relatively short, standard forward stroke. Whenever instead a cigarette is missing or is not provided with the filter tip, and/or whenever the degree of filling of a cigarette end is an unsufficient one, the corresponding feeler pin is caused to move forward under the bias of the associated biasing spring, over a longer than standard stroke, such as, for example, over the longest allowed stroke. In both instances, the differing length of the feeler pin forward stroke is used for such a testing. Once the testing has been effected, the control means will retract and hold the feeler pin or pins into their rest position, thus loading the respective biasing spring or springs.

The advantages attained by this invention appear evident from the foregoing. In fact, by contemplating only the movement of the feeler pin or pins, that have a mass and consequently an inertia which are considerably smaller than those of the block supporting same, the operation of the testing or levelling device synchronously with a very fast movement of the cigarettes to be tested or levelled, presents substantially smaller difficulties, and can be achieved with a remarkably simplified construction, and also with a reduction in the device overall dimensions.

BRIEF DESCRIPTION OF THE DRAWINGS

These and other characteristic features of the invention and the advantages arising therefrom will appear in more detail from the following specification of some embodiments diagrammatically shown by way of non-limiting examples in the accompanying drawings, in which.

DESCRIPTION OF THE PREFERRED EMBODIMENTS

Figure 1:
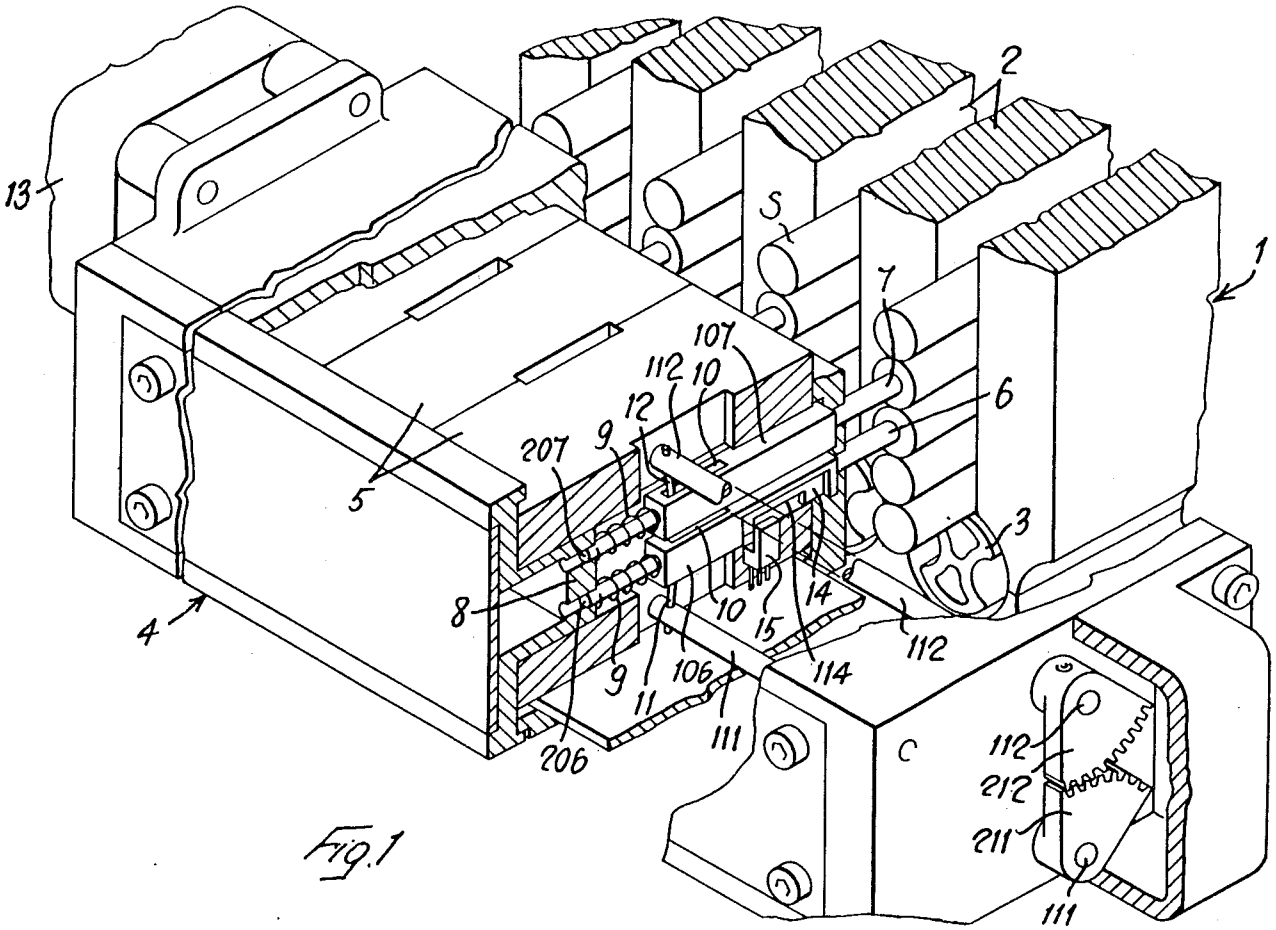
FIG. 1 is a partly sectioned perspective view showing one embodiment of the feeler pin device according to the invention, which is used for the cigarette quality testing (presence of the filter tip and/or degree of filling of the cigarette ends) at the ducts for guiding down the cigarettes provided in the hopper for feeding a cigarette-packing machine.
Figure 2:
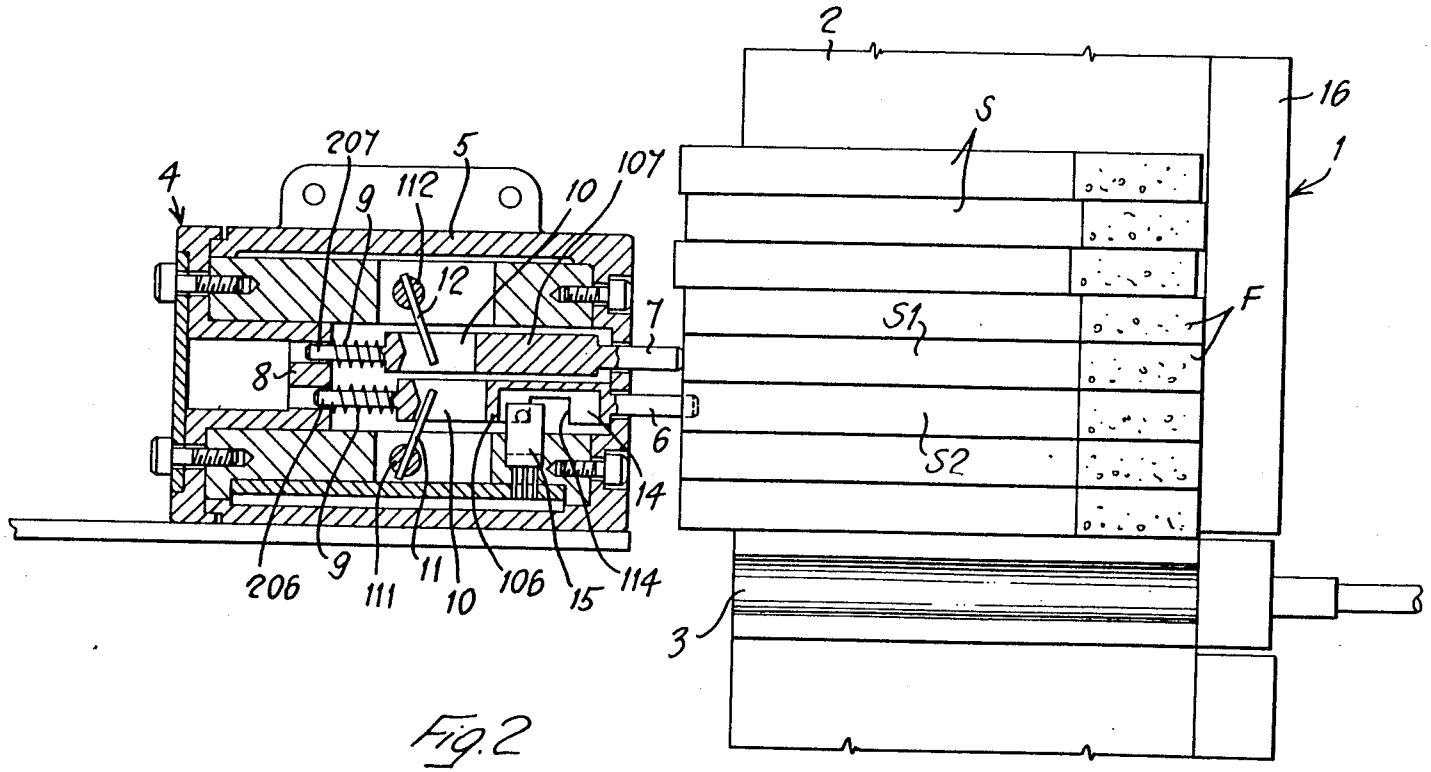
FIGS. 2 and 3 are vertical sectional views respectively showing the testing device according to FIG. 1 in two different operative positions.
Figure 3:
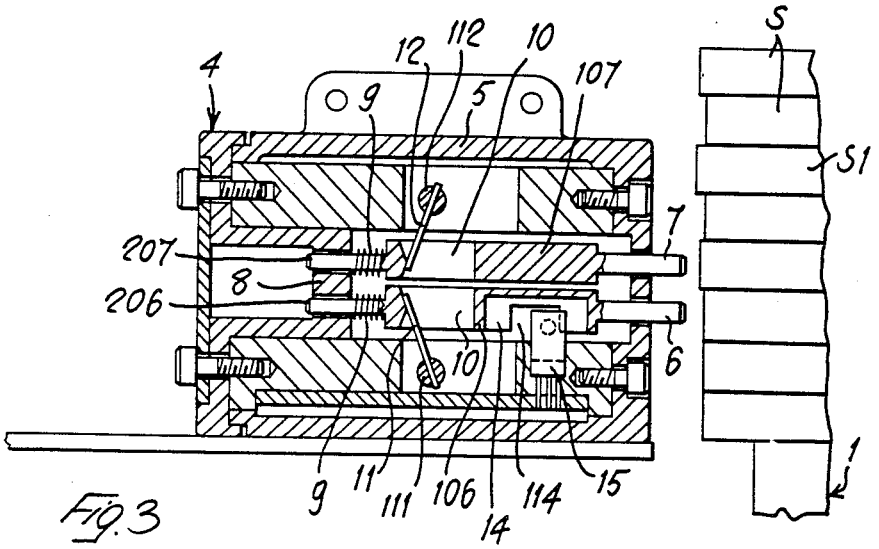

In FIGS. 1 to 3, by numeral 1 it is designated the hopper for feeding a cigarette-packing machine. In its bottom section, this hopper 1 comprises a set of ducts 2 set side-by-side for guiding down the cigarettes, which are adapted for containing each one cigarette pile formed of only one single row of superposed parallel cigarettes S. In each cigarette-guiding duct 2 there is provided a rotary fluted transferring device 3 which is intermittently rotated so as to transfer each time one cigarette S from the upper section of the respective cigarette-guiding duct 2 either to the lower section of this duct (when by the preceding testing device the cigarette has been found to be a regular cigarette), or to a lateral cigarette-rejection position (when by the testing device the cigarette has been found to be a defective cigarette), as disclosed in more detail in the Italian Patent Application No. 12606 A/82 (corresponding to U.S. application Ser. No. 06/159,593, filed Aug. 2nd, 1983).

In the section of each cigarette-guiding duct 2 which is over the respective rotary fluted transferring device 3, the cigarettes S run down by steps and pass beyond a frontally arranged stationary testing device 4 which during the dwell times of the cigarettes S in the said cigarette-guiding ducts 2, is set into operation so as to test (as in the illustrated example) the degree of filling of the cigarette fore ends, since it is situated at the side of hopper 1 toward which the cigarette ends with no filter tip are turned. Of course, a testing device 4 of this kind may be also provided at the opposite side of hopper 1 for testing the presence of the filter tip F in the cigarettes (in the instance of filter cigarettes), or the degree of filling of the opposite cigarette end (in the instance of filterless cigarettes).

The testing device 4 comprises a plurality of individual testing devices 5 each associated to one cigarette-guiding down duct 2 in hopper 1, and arranged side-by-side so as to compose a suitably supported bar-like member extending horizontally across the width of hopper 1. Each individual testing device 5 comprises two superposed feeler pins 6 and 7 arranged in a co-axial relation with the positions of two superposed cigarettes S in the associated cigarette-guiding duct 2 in hopper 1. The lower feeler pin 6 performs a testing function, while the upper feeler pin 7 performs a levelling function, that is to say, the function of coplanarly aligning the end surfaces of the cigarettes S.

The feeler pins 6, 7 are cylindrical pins, with their tips being shaped like a truncated cone, and are each integral with a corresponding parallelepipedal slider 106, 107. The two superposed sliders 106, 107 are housed for an axially sliding movement in the housing of the respective testing device 5, and the corresponding feeler pins 6, 7 project from the bores in the front end of said housing, for a sliding movement toward the cigarettes S in the associated cigarette-guiding duct 2, so that these feeler pins provide also the sliding support of the fore ends of sliders 106, 107. At their rear ends, the two sliders 106, 107 have each a cylindrical appendix 206, 207 slidably engaging in a corresponding aperture provided in wall 8 of the housing of the testing device 5. Thus the support for the sliding movement of the rear ends of sliders 106, 107 is obtained. Around the rear appendix 206, 207 of each slider 106, 107 there is wound a helical pressure spring 9, which is arranged between the respective slider and the wall 8 of the testing device housing.

The sliders 106, 107 of the two feeler pins 6, 7 are each formed with a longitudinal slot 10, the rear end of which, that is to say, the end remote from the respective feeler pin 6, 7, consists of a convex wall presenting in vertical section the profile of a recumbent V, with the vertex of the V projecting inwardly of the respective slot 10. In slot 10 of slider 106 for the lower feeler pin 6 (testing pin) there is engaged from below a control pin 11 which is designed for cooperating with the V-shaped rear wall of said slot 10. Similarly, in slot 10 of slider 107 for the upper feeler pin 7 (levelling pin) there is engaged from above a control pin 12 which cooperates with the V-shaped rear wall of said slot. The control pins 11 which are respectively associated to the testing feeler pins 6 of the individual testing devices 5, are secured to the corresponding control pin-carrying shaft 111 extending transversely to the feeler pins 6, 7 along the longitudinal direction of the bar-like member 4 composed of the individual control devices 5. Similarly, the control pins 12 which are associated to the levelling feeler pins 7 of the individual testing devices 5, are secured to a control pin-carrying shaft 112 extending transversely to the feeler pins 6, 7 and parallel to shaft 111 along the longitudinal direction of the bar-like member 4 composed of the individual testing devices 5. At one of their ends, the two control pin-carrying shafts 111 and 112 are connected the one to the other through sector gears 211 and 212, and one of these shafts is connected to a reversible electric motor 13 which, for example, is of the step-by-step type.

The slider 106 of the testing lower feeler pin 6 of each control device 5 has a partition 14 arranged, for example, on the lower side thereof, and extending in the running direction of said slider 106, and presenting a slot 114. A photosensitive element 15 is provided at a fixed position on one side of this partition 14, and a light source (not shown) is associated thereto and is arranged in a fixed position on the opposite side of partition 14.

In their rest position shown in FIG. 3, the feeler pins 6, 7 of each testing device 5 are retracted from the row of cigarettes S within the associated cigarette-guiding duct 2 in the packing machine hopper 1, and are held in this retracted position by the control pin or pins 11 and 12, against which the sliders 106, 107 under the bias of springs 9, bear by the convex rear walls of their slots 10. The slots 114 in the partitions 14 carried by the sliders 106 of the control feeler pins 6 are located in correspondence of the respective photosensitive element 15, whereby they allow the light to pass therethrough from the light source against the photosensitive element 15.

To effect the cigarette control, the pin-carrying shafts 111, 112 are so rotated by the motor 13 that the control pins 11, 12 let the sliders 106, 107 and the respective feeler pins 6, 7 move, under the bias of pressure springs 9, axially toward the respective cigarettes S. Preferably, such a release of sliders 106, 107 and the respective feeler pins 6, 7 does not occur all of a sudden, but rather gradually, since the control pin-carrying shafts 111, 112 are rotated slowly enough for accompanying the feeler pins 6, 7 under the bias of springs 9, in their forward movement toward the cigarettes S. Thus, the forward movement of sliders 106, 107 under the bias of springs 9, is so controlled that the impact of the feeler pins 6, 7 on the cigarette S will be greatly reduced. The sliders 106, 107 are allowed to advance under the bias of springs 9 until the respective feeler pins 6, 7 are caused to contact the end surfaces of the facing cigarettes, whereby these pins apply thereon a certain axial pressure, corresponding to the pressure of springs 9, as shown in FIG. 2.

In this way, when a levelling feeler pin 7 runs into a cigarette S1 with its fore end projecting by a more than standard amount from the respective cigarette-guiding duct 2 in hopper 1, this pin will push the said cigarette S1 backward, against a fixed cigarette-aligning abutment 16 in cooperative relation with the opposite end thereof, so that it sets in a predetermined vertical plane the fore end of said cigarette S1 to be tested, that in the subsequent testing step will be tested by the underlying testing feeler pin 6, when the whole row of cigarettes S has run down by one step through the respective cigarette-guiding duct 2 in hopper 1, so that the cigarette S1 comes to be in front of the testing pin 6.

Whenever a testing feeler pin 6 runs into a cigarette S with a regular filling at its fore end, such a filling will resist the pressure of spring 9 and will stop the feeler pin 6 before the slider 106 reaches the end of its travel, at a position in which the slot 114 in the partition 14 carried by the respective slider 106, still lets the light pass through from the light source to the photosensitive element 15, thus maintaining the electrical rest condition of this element, a condition which is indicative of the regular filling of the cigarette fore end. Whereas, whenever the testing feeler pin 6 runs into a cigarette S2 with an empty or unsufficiently filled fore end, the pressure of spring 9 will overcome the resistance offered to the testing feeler pin 6, and this pin will penetrate axially into the fore end of cigarette S2, so that the respective slider 106 is permitted to reach the end of its longest allowed travel, as shown in FIG. 2. In this end position of slider 106, its partition 14 intercepts the light from the light source to the respective photosensitive element 15. The corresponding electric condition of the photosensitive element 15 gives the indication that the controlled cigarette S2 is a defective cigarette. This defective cigarette S2 will be subsequently discarded, when it is received in the rotary fluted transferring device 3, and by this device it is moved into a lateral position, as disclosed in the aforementioned Italian Patent Application No. 12606 A/82 (corresponding to U.S. application Ser. No. 06/519,593, filed Aug. 2nd, 1983).

After the feeler pins 6, 7 have been moved forward under the bias of springs 9, as above-described, the pin-carrying shafts 111, 112 are rotated by the motor 13 in the reverse direction to the previous direction of rotation, to retract by means of the control pins 11, 12 the sliders 106, 107, and so the respective feeler pins 6, 7 into their rest position shown in FIG. 3, and to hold them in this retracted position until the next release and the consequent forward movement thereof. By the retraction of sliders 106, 107 into rest position, the pressure springs 9 are loaded.

The above-disclosed operations for levelling and testing the cigarettes S, which are accomplished by causing the feeler pins 6, 7 to be moved forward under the bias of springs 9, and to be subsequently retracted against the bias of springs 9, are carried out during the dwell times in the stepwise downward movement of the cigarettes through the cigarettes-guiding ducts 2, that is to say, during those periods of time in which the cylindrical sectors of the rotary fluted transferring devices 3 are supporting the overlying cigarette piles bearing thereon, as shown in FIG. 1. Therefore, the motor 13 which drives the shafts 111, 112 carrying the control pins 11, 12, is synchronized with the motors which drive the fluted transferring devices 3.

It should be further appreciated that the whole testing device 4 which is constituted by the bar-like member composed of the individual testing devices 5 set side-by-side, can be moved toward and away from the packing machine hopper 1, in order to adjust its working distance from the cigarettes.

Figure 4:
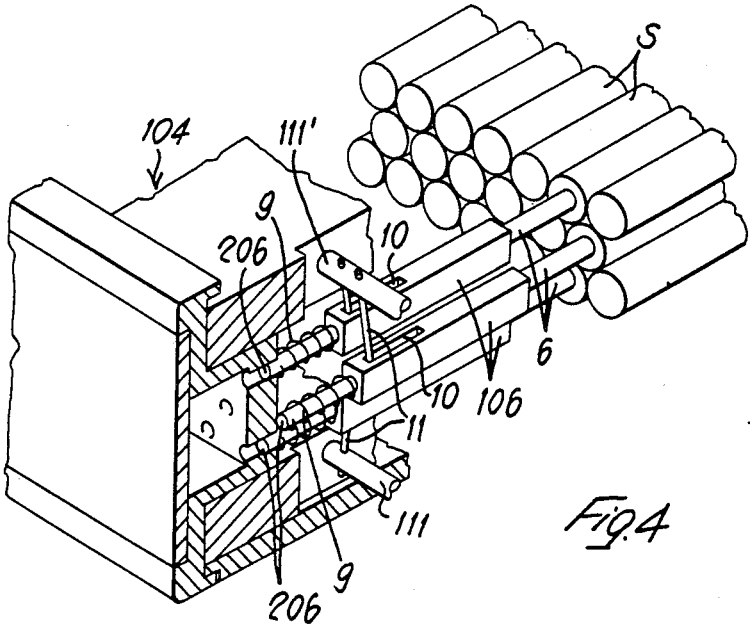
FIG. 4 is a partly sectioned perspective view showing a portion of a feeler pin device according to the invention, which is used for the quantity testing of the cigarettes in an orderly group of cigarettes to be packed.

In FIG. 4 there is shown a device 104 for the quantity testing of the cigarettes S forming part of a group of twenty cigarettes lying in a quincuncial arrangement of three superposed rows. These orderly groups of cigarettes may be contained, for example, within the flutes of a stepwise-rotatable known compressor drum, and the cigarette quality testing may be effected during the dwelling of each cell in said drum at a specific testing station in which the testing device 104 is fixedly located in front of the cell. This testing device 104 therefore comprises twenty feeler pins 6 performing a testing function, and being each associated to one cigarette S in the cigarette group, that is to say, these feeler pins are set in a quincuncial arrangement of three superposed rows. Similarly as described by referring to FIGS. 1 to 3, also in the embodiment according to FIG. 4 the feeler pins 6 are integral of sliders 106 provided with guiding appendices 206 at their rear end, and which are urged toward the cigarettes by pressure springs 9. The sliders 106 are provided with longitudinal slots 10 in which the control pins 11 are engaged. The control pins that are associated to the feeler pins 6 in the lower row, are fastened to a lower control pin-carrying shaft 111, while the control pins 11 that are associated to the feeler pins 6 in the upper and in the intermediate rows, are fastened to an upper control pin-carrying shaft 111'. The testing device 104 according to FIG. 4 is otherwise constructed and operated in the same manner as the device 4 according to FIGS. 1 to 3. To simplify the drawing, the sensors or photosensitive elements 15 associated to the several feeler pins 6, the respective light sources, and the partitions 14, 114 carried by the sliders 106, are not illustrated in FIG. 4.

Before being brought in front of the control device 104, the orderly cigarette group is subjected to a levelling operation, whereby the cigarette ends which are to be engaged by the testing feeler pins 6, are set in a coplanar relation. To this end, any levelling device may be used, which will be, for example, located at a station for the compressor drum cells, arranged prior to the station in which the testing device 104 is situated. Also for the levelling of the cigarettes S in the orderly cigarette groups, a feeler pin device like the one according to FIG. 4 may be used, however without means being responsive to the length of each feeler pin forward stroke, similarly as described in connection with the levelling feeler pins 7, by referring to FIGS. 1 to 3.

It is evident that the device according to FIG. 4 may be also used for a quality testing of the cigarettes in an orderly cigarette group, to ascertain the degree of filling of the cigarrete ends, and/or the presence of the filter tip, as disclosed by referring to FIGS. 1 to 3, since the testing feeler pins 6 will react to a cigarette with an empty or filterless end in the same manner as they react to a missing cigarette.

We claim:

1. In a feeler pin device for rod-like articles having ends, said device being provided with at least one feeler pin which is arranged in a substantially co-axial relation with a respective article and which is moved axially from a retracted rest position toward the respective article so as to contact the end thereof and apply thereon an elastic pressure, the improvement wherein: the at least one feeler pin is held in its retracted rest position within a fixed support member against the bias of a respective biasing spring by control means which lets the at least one feeler pin move forward, relatively to the fixed support member, under the action of the respective biasing spring, toward the respective article, and which retracts the at least one feeler pin into the rest position, against the action of the respective biasing springs.

2. The device according to claim 1, wherein the control means accompanies the forward movement of the at least one feeler pin from its retracted rest position toward the respective article, so as to control the said forward movement of the at least one feeler pin and to attenuate the impact of the at least one feeler pin against the article.

3. The device according to claim 1, wherein the control means consists of a control pin which is engaged in a longitudinal slot formed in the body of the at least one feeler pin, and is fastened to a control pin-carrying shaft which is directed transversely to the at least one feeler pin and is rotatable in either direction.

4. The device according to claim 3, wherein a plurality of feeler pins are set in a parallel side-by-side relation, and wherein the control pins associated to the feeler pins are fastened to only one control pin-carrying shaft.

5. The device according to claim 4, wherein two two feeler pin rows are arranged in a parallel, superposed relation, and wherein the the control pins which are associated with the upper feeler pin row are fastened to a control pin-carrying shaft located over the feeler pins, while the control pins which are associated with the lower feeler pin row are fastened to a control pin-carrying shaft located under the feeler pins.

6. The device according to claim 5, wherein the two control pin-carrying shafts are arranged in a parallel, superposed relation, wherein the control pin-carrying shafts are coupled the one to the other by means of gearing, and wherein one of the said shafts is driven by a reversible electric motor.

7. The device according to claim 4, wherein two feeler pins are arranged in a parallel, superposed relation, and wherein the control pin which is associated with the upper feeler pin is fastened to a control pin-carrying shaft located over the feeler pins, while the control pin which is associated with the lower feeler pin is fastened to a control pin-carrying shaft located under the feeler pins.

8. The device according to claim 3, wherein the motor is a step-by-step motor.

9. The device according to claim 3, wherein each control pin cooperates with a convex end wall of the longitudinal slot in the respective feeler pin body.

10. The device according to claim 1, wherein the articles are cigarettes and wherein the device is used for the quality testing of cigarettes running down by steps the one after the other through cigarette-guiding ducts in a hopper for feeding a cigarette-packing machine.

11. The device according to claim 10, wherein the feeler pin device includes an upper feeler pin performing a levelling function, and a lower feeler pin performing a testing function, said lower feeler pin being associated with means responding to the length of its forward stroke, the said upper and lower feeler pins being located in correspondence of each cigarette-guiding duct in the hopper for feeding a cigarette-packing machine.

12. The device according to claim 1, wherein the articles are cigarettes and wherein the device is used for quantity testing of the cigarettes in an orderly cigarette group to be packed.

13. The device according to claim 1, wherein the articles are cigarettes and wherein the device is used for levelling the cigarettes in an orderly group of cigarettes to be packed.

14. The device according to claim 1, wherein the articles are cigarettes disposed in a column, and wherein the at least one pin shifts the cigarettes against a cigarette-aligning abutment.

15. The device according to claim 1, wherein the articles are cigarettes, and further comprising means cooperating with the at least one pin for ascertaining whether a cigarette is present at a position to be engaged by said at least one pin.

16. The device according to claim 1, wherein the articles are cigarettes, and wherein the at least one pin signals the degree of filling of the cigarette ends.

17. The device according to claim 1, wherein the articles are filter-tipped cigarettes, and wherein the at least one pin signals whether filter tips are present.

* * * * *